US006303889B1

(12) United States Patent
Hayduchok et al.

(10) Patent No.: US 6,303,889 B1
(45) Date of Patent: Oct. 16, 2001

(54) METHOD AND APPARATUS FOR SORTING DOCUMENTS INTO A PRE-DEFINED SEQUENCE

(75) Inventors: George L. Hayduchok, Mount Holly; Robert R. DeWitt, Marlton, both of NJ (US)

(73) Assignee: Opex Corporation, Moorestown, NJ (US)

( * ) Notice: Subject to any disclaimer, the term of this patent is extended or adjusted under 35 U.S.C. 154(b) by 0 days.

(21) Appl. No.: 09/504,352

(22) Filed: Feb. 15, 2000

(51) Int. Cl.[7] ..... B07C 5/00

(52) U.S. Cl. ..... 209/584; 209/509; 209/552; 209/576; 209/583; 209/608

(58) Field of Search ..... 209/509, 552, 209/576, 578, 583, 584, 597, 608

(56) References Cited

U.S. PATENT DOCUMENTS 5,009,321 * 4/1991 Keough ..... 209/3.1
5,104,681 * 4/1992 Sansone ..... 427/8
5,353,938 * 10/1994 LaGrange et al. ..... 209/584
5,740,921 * 4/1998 Yamashita et al. ..... 209/584
5,901,855 * 5/1999 Uno et al. ..... 209/584
5,998,752 * 12/1999 Barton et al. ..... 209/583

* cited by examiner

*Primary Examiner*—Donald P. Walsh
*Assistant Examiner*—Mark J Beauchaine
(74) *Attorney, Agent, or Firm*—Dann, Dorfman, Herrell and Skillman; Stephen H. Eland

(57) ABSTRACT

A method and apparatus are provided for sorting documents. The documents are scanned to determine a characteristic of each document and then sorted in response to the scanned characteristic. In particular, a method is provided for multi-pass processing of documents. In accordance with one method, each document is assigned a logical sort number corresponding to the recipient of the document. The documents are then sorted in sequential order according to the logical sort numbers. A method is also provided that compares data scanned during a pass with data obtained during a previous pass to determine the recipient of the document. In addition a method is provided for marking the documents and sorting the documents so that the markings provide indicators of pre-defined groups of documents.

45 Claims, 3 Drawing Sheets

METHOD AND APPARATUS FOR SORTING DOCUMENTS INTO A PRE-DEFINED SEQUENCE

FIELD OF THE INVENTION

The present invention relates to a method and apparatus for sorting documents into a pre-defined sequence. Specifically, the present invention operates to process stacks of documents, such as envelopes. The documents are serially fed from an input bin and scanned to detect a characteristic such as the Post Office box or customer name for the recipient. The documents are then sorted into output bins according to the scanned characteristic.

BACKGROUND

When processing mail, it may be desirable to sort the mail into a pre-defined sequence. One such application relates to sorting mail received by wholesale lockbox processing centers. A wholesale lockbox processing centers receives payments for numerous companies, e.g. 1000–2000 companies. Each company or account pays the wholesale lockbox processing centers a fee to process each payment and deposit the payment as soon as possible. Generally the wholesale lockbox processing center makes several trips to the Post Office each day to pick up the mail. Each time the wholesale lockbox processing center picks up a batch of mail, they attempt to process the batch right away without waiting for another batch.

Generally, the deposits are processed according to instructions from the account holder. The instructions are often fairly complex and different accounts generally have different instructions. Therefore, it is not efficient to have every operator learn the instructions for every account. To process the documents efficiently, each account is assigned to a particular operator or a group of operators. For instance, the mail for about 30 accounts may be assigned to a particular operator. Alternatively, the mail for about 200 accounts may be assigned to a group of seven or eight operators, referred to as a work group. This allows the operators to become proficient processing the mail for the accounts assigned to the operator or work group. Accordingly, the incoming mail is sorted and separated so that all of the mail for a particular account is grouped together and delivered to the assigned operator or work group.

Conventional manual sorting is done numerically based on the P.O. Box number of the envelope. The process requires as many sort bins as accounts, and is usually done in two passes. For example, if there are 1000 accounts, the manual sorting uses 1000 bins. The first pass separates the envelopes into a relatively small number of piles of envelopes, for example 10 to 15 piles. Depending on the numbering system of the P.O. Boxes, the first sort can be as simple as using the first digit of a three digit P.O. Box number to create ten piles of one hundred P.O. Boxes.

The second pass typically requires sorting to numerous bins and is considerably slower than the first pass. During the second pass, the envelopes are usually sorted into 10 by 10 sort racks, which have 10 rows of 10 columns of bins. In the example of 1000 accounts, there will be 10 such sort racks, each having 100 bins. Each envelope is examined and placed into the appropriate bin in the appropriate sort rack.

The second pass results in the envelopes being sorted into numerical order according to the P.O. Box number. For instance, in the example of a batch of mail having three digit P.O. Box numbers, the batch of envelopes is separated into 10 piles of envelopes according to the first digit of the P.O. Box number. During the second pass each of the 10 piles is sorted separately. When processing the first pile of envelopes, the envelopes are placed into the individual bins in the first sort rack according to the second two digits of the P.O. Box number. For instance, the envelopes for P.O. Box 001 are placed in the second bin in the first row of the first sort rack and the envelopes for P.O. Box 111 are placed in the second bin of the second row of the sort rack. All of the envelopes in the first pile are sorted in this manner. The operator then sorts the remaining piles of documents into the bins of the other nine sort racks in a similar manner.

If the accounts are assigned to operators or work groups in numerical order, then the documents are ready to be distributed to the work groups after the second pass of the manual sorting. The envelopes are removed from the bins in order so that the envelopes in the sort bins are maintained in sequential order according to P.O. Box number. Frequently when the operator removes the envelopes from a particular bin, the operator will put a rubber band around the envelopes so that all of the envelopes for a particular account are grouped together and separated from other accounts.

Although it is possible to have the accounts assigned to the work groups in numerical order, the accounts for a work group are generally not sequential according to P.O. Box number. This is due to adding and deleting customers over the years. Therefore, after the documents are sorted into numerical order according to account, the documents are further sorted by work group. One manner for doing this is to color-code the individual bins of the sort racks according to work group. For instance, all of the bins for receiving documents for the first work group could be tagged with a yellow label. After the second pass of the manual process sorting, the operator removes the documents from the yellow labeled bins in order. In other words if the first work group includes P.O. Box numbers 001–050, 123–150, and 300–327, the operator removes the documents from the appropriate bins so that the documents are in order from lowest P.O. Box number to highest P.O. Box number.

Such a manual sorting system is labor-intensive and requires significant room for all of the sort bins. Accordingly, an efficient automated process for sorting the documents is desirable. A semi-automated process has been utilized, but the known systems require utilization of a significant number of receiving bins for the automated sorter. For instance, the known semi-automated system may utilize upwards of 50 bins. In addition, the semi-automated process rejects a significant number of documents. These documents are typically processed according to the manual system described above.

SUMMARY OF THE INVENTION

The present invention provides a method and apparatus for processing documents for a plurality of recipients, utilizing a sorting apparatus having a number of bins. A batch of documents is conveyed along a document path. Each document in the batch is scanned to determine a characteristic indicative of the recipient of each document. The number of bins in the sorting apparatus is optimized for a given number of passes through the sorting machine and a given number of recipients. Alternatively the number of passes is optimized for a given number of bins and a given number of recipients.

Further, the present invention provides a method comprising the step of conveying documents along a document path and scanning the documents as the documents are conveyed along the document path to determine a characteristic indicative of the recipient of each document. Logical sequence numbers are assigned to the documents such that the logical sequence number for a document corresponds to the recipient of the document. The documents are then sorted into a plurality of bins according to the logical sequence numbers. Preferably, a radix for the logical sequence numbers is selected such that the radix corresponds to the number of bins.

The present invention further provides a multi-pass method for processing documents for a plurality of recipients. During the first pass, a document is conveyed along a document path and the document is scanned to determine a first characteristics indicative of the recipient of the document and the document is scanned to determine a second characteristic of the document. During the second pass, the document is conveyed along the document path and is scanned to determine the second characteristic for the document. The recipient of the document is determined based on the scanned second characteristic.

The present invention also provides a multi-pass method for processing documents in which a document is scanned during the first pass to determine data regarding a first characteristic of the document. The recipient of the document is determined and the document is then sorted in response to the determined recipient. During the second pass, the document is scanned to determine data regarding the first characteristic of the document. The data obtained during the second pass is compared with the data obtained during the first pass to determine the recipient of the document.

In addition, the present invention provides a method for processing documents in which the documents are conveyed along a document path and scanned to determine a characteristic of each document. A print location on each document is determined in response to the scanned characteristic for each document. A mark is then printed in the determined print location for each document.

DESCRIPTION OF THE DRAWINGS

The foregoing summary, as well as the following detailed description of the preferred embodiments will best be understood when read in conjunction with the drawings, in which.

DETAILED DESCRIPTION OF THE PREFERRED EMBODIMENTS

Figure 1:
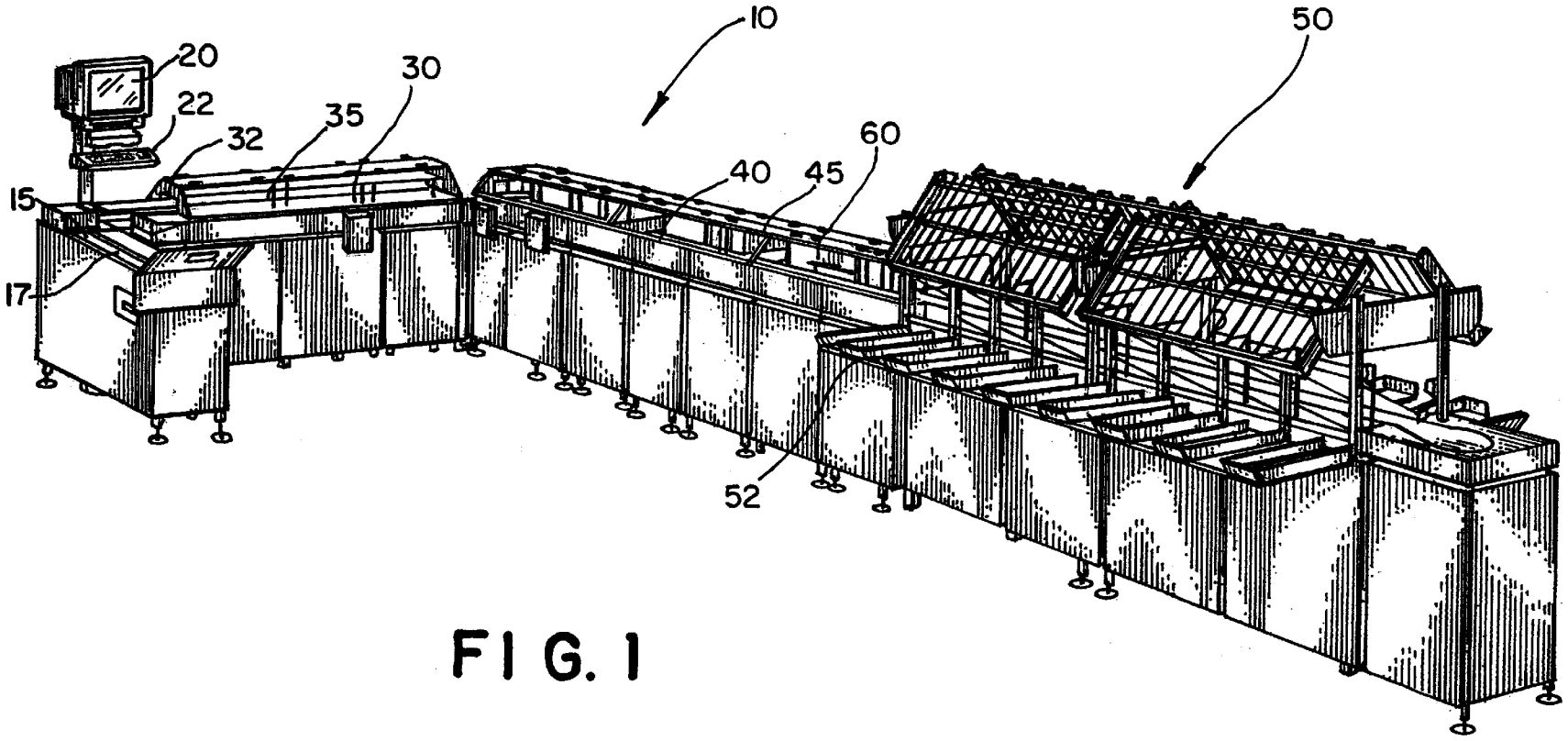
FIG. 1 is an automated mail processing apparatus manifesting aspects of the present invention.
Figure 2:
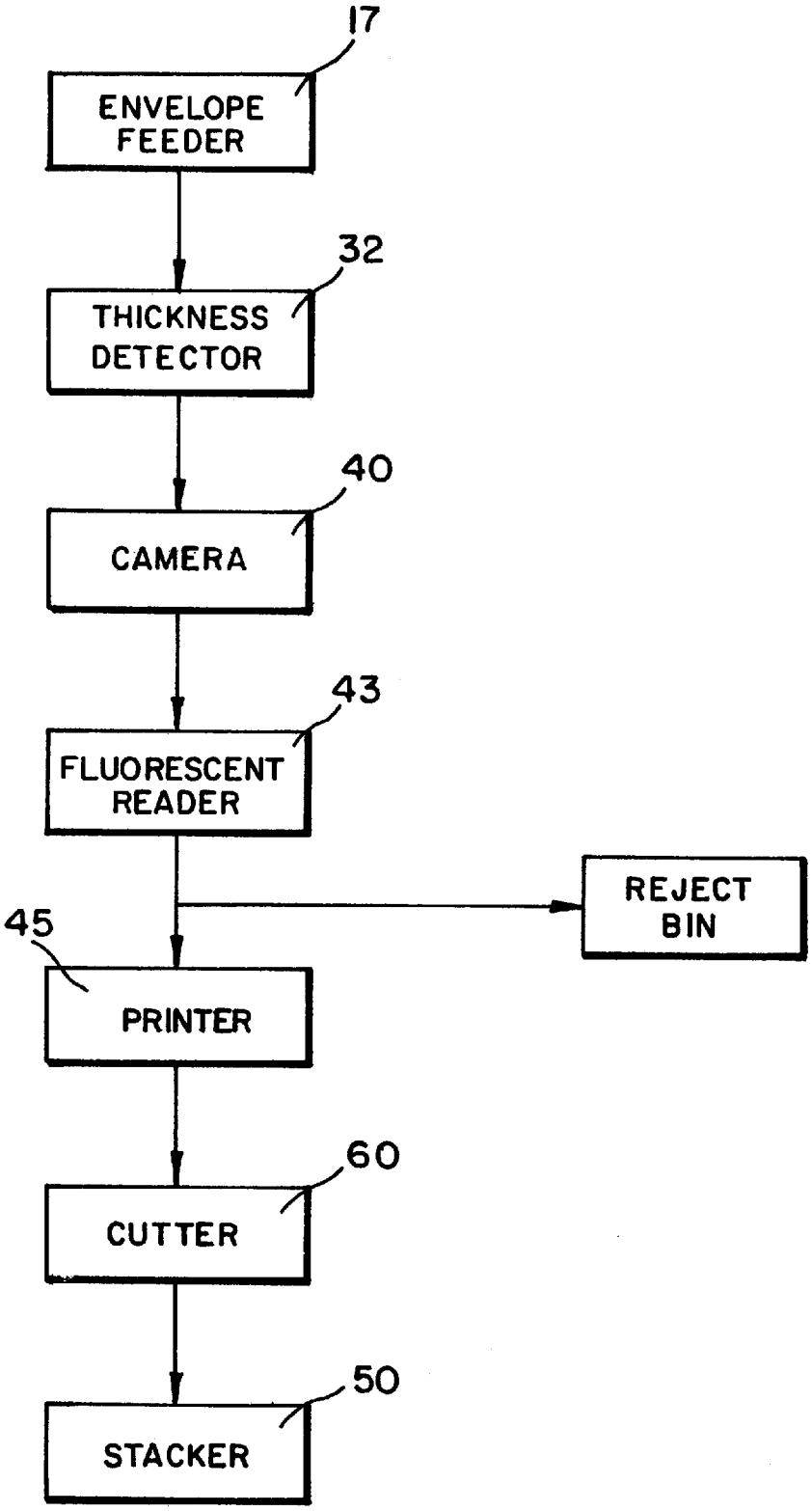
FIG. 2 is a block diagram showing the flow of mail through the automated mail processing apparatus shown in FIG. 1.
Figure 3:
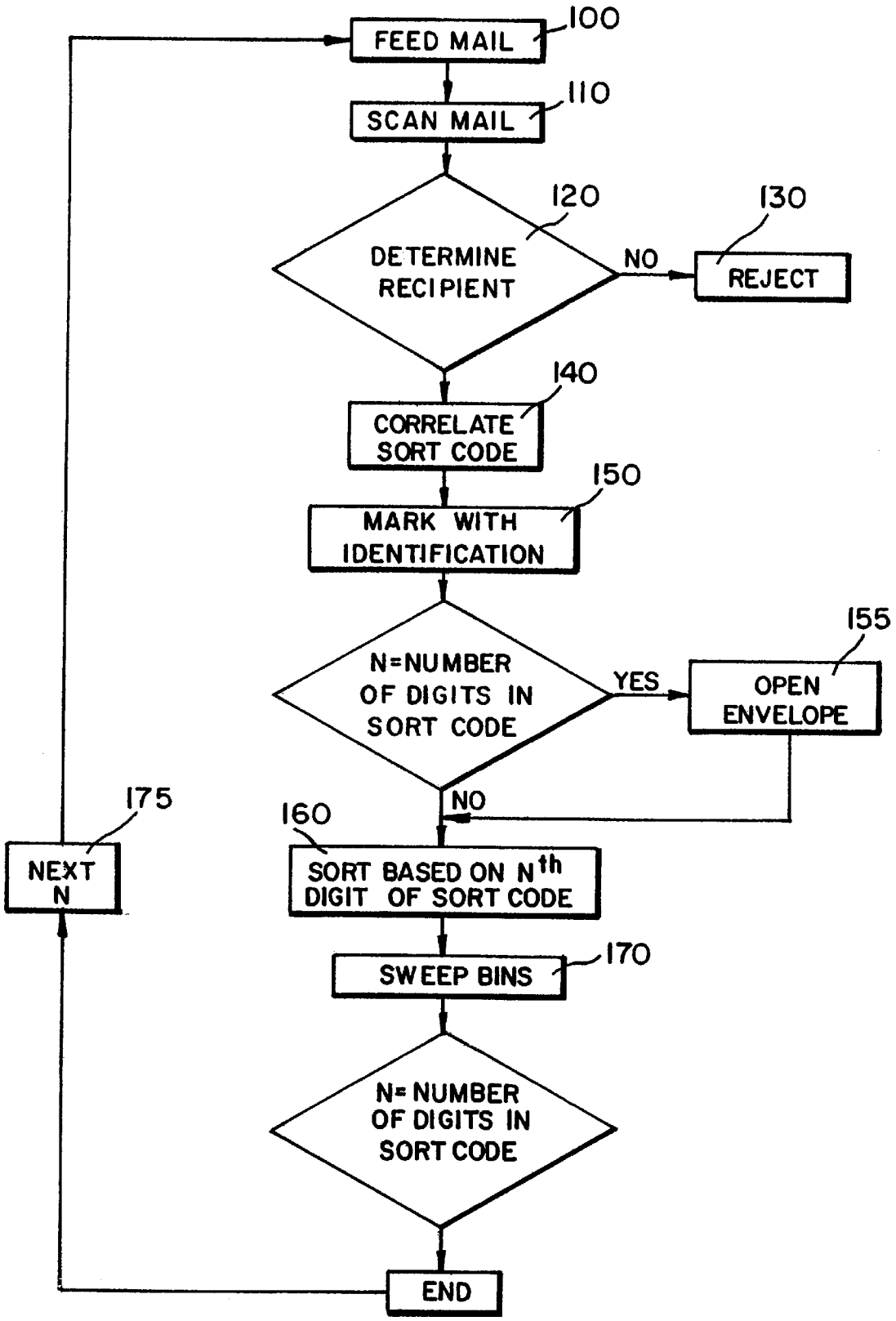
FIG. 3 is a block diagram showing the flow of mail processed according to a method utilizing the apparatus shown in FIG. 1.

Referring now to FIGS. 1–3 in general, and to FIG. 1 specifically, an automated mail processing apparatus 10 is illustrated. The apparatus 10 operates to process mail by receiving stacks of mail and serially feeding the pieces into a system transport 30 that conveys the envelopes along a document path. The apparatus 10 scans each envelope to detect various characteristics of the envelopes. In response to the detected characteristics, the apparatus 10 selectively sorts each envelope into one of a plurality of sort bins in a sorter 50. More specifically, preferably the apparatus scans the envelopes to determine the recipient of each envelope and then sorts the envelopes into a pre-defined sequence in order to facilitate further processing.

The apparatus includes an input bin 15 for receiving a batch of mail. A feeder 17 serially feeds the envelopes into a system transport 30 that conveys the envelopes in serial fashion through the apparatus 10. An entry sensor 32 detects the entrance of each envelope as each envelope enters the system transport. The entry sensor also detects the length of each envelope. The system transport conveys the envelopes to a thickness detector 35 that detects the thickness of each envelope. If the thickness of an envelope does not fall within a pre-defined thickness range, the envelope is electronically tagged and outsorted. From the thickness detector 35 the envelopes are conveyed to an optical imaging station 40. At the optical imaging station 40, the apparatus attempts to read information indicative of the recipient, such as the recipient's name and/or Post Office box number. The apparatus utilizes the identity of the recipient of an envelope to sort the envelope.

The apparatus may also include a printer 45 for printing identification information on an envelope after the envelope is identified. The envelopes are then conveyed to a sorter 50 that sorts the envelopes based upon each envelope's recipient. If the apparatus cannot determine the recipient of an envelope, the envelope is rejected and processed separately as discussed further below.

Referring now to FIGS. 1 and 2, the apparatus 10 will be described in greater detail. The apparatus includes an input bin 15 for receiving a batch of mail. The mail includes a plurality of envelopes of various sizes containing various documents. In the present instance, the apparatus is configured to process envelopes containing documents, without extracting the documents from the envelopes. In certain situations it may be desirable to sort documents according to the process described below after the documents have been extracted from the envelopes. Accordingly, in the following description, the term document is meant to include both envelopes with or without documents as well as documents that are not contained within envelopes.

The apparatus 10 includes a system controller that monitors the progress of each envelope as the envelopes are processed. The system controller tracks the sequence and location of each envelope, and controls various gates along the document path to control the processing of each envelope. The system controller receives signals from various sensors along the document path and from the various stations along the document path. The system controller controls the processing of each envelope in response to these signals.

The apparatus further includes a computer in the form of a microprocessor that receives information regarding each envelope and builds a data record for each envelope. The data record for each envelope includes information such as the sequence number of the envelope (i.e. whether the envelope was the first, second or third envelope processed), the length of the envelope and the recipient of the envelope. The information in the data record for each envelope can be used to facilitate further processing of the envelopes as is described in further detail below.

To begin processing a batch of mail, the batch of mail is placed into the input bin 15 so that the envelopes are resting on edge. The bottom of the input bin 15 comprises a conveyor, on to which the stack of mail is placed. The conveyor conveys the batch of mail toward a feeder 17 that serially feeds the envelopes into the system transport 30.

The system transport 30 is comprised of a plurality of opposing belts entrained about a plurality of idler and drive pulleys. The envelopes are transported by the system transport between the opposing belts. A sensor 32 adjacent the entrance of the system transport 30 senses the leading edge of each envelope as the feeder 17 feeds the envelopes into the system transport 30. The entry sensor 32 can be one of a variety of types of sensors. In the present instance, the entry sensor 32 comprises an infrared transmitter and an infrared receiver that straddle the document path.

As the leading edge of an envelope enters the system transport, the entry sensor 32 detects the leading edge of the envelope. As the envelope is conveyed past the sensor, the sensor also detects the trailing edge of the document. Since the speed of the system transport is known, the length of the envelope can be determined based on the speed of the system transport and the time interval between the time the entry sensor detects the leading edge of the envelope and the time the entry sensor detects the trailing edge of the envelope. In this way, the entry sensor operates as a length detector.

The entry sensor also operates to signal to the system controller that the envelope has been conveyed to the entrance of the system transport. A similar sensor is located at each of the various stations along the document path, which transmit a signal to the apparatus indicating that the envelope has arrived at the next station. In this way, the system controller tracks each envelope as it passes through the apparatus.

The system transport 30 conveys the envelopes to the thickness detector 35. The thickness detector measures the thickness of an envelope at a plurality of points along the length of the envelope as the envelope is conveyed along the document path. The thickness detector 35 includes a pair of idler rollers forming a nip. One of the idler rollers is pivotable so that the distance between the idler rollers is variable to accommodate envelopes of different thicknesses. The thickness detector 35 monitors the displacement of the pivotable idler roller as an envelope is conveyed between the idler rollers to determine the thickness of the envelope. The details of a preferred configuration for the thickness detector are set forth in U.S. patent application Ser. No. 08/140,236, entitled "Apparatus for Detecting the Thickness of Documents", filed Aug. 26, 1998, which is hereby incorporated by reference as if fully set forth herein. If the detected thickness of an envelope is not within pre-defined thickness parameters, the envelope is electronically tagged and outsorted.

The acceptable thickness parameters can vary depending on the particular application. For instance, in certain applications it may be desirable to separate all envelopes having a thickness greater than a pre-defined thickness. Any envelope having a thickness that exceeds this pre-defined thickness is outsorted.

From the thickness detector, the envelopes are conveyed to the imaging camera 40. The imaging camera 40 comprises at least one line scan camera 42 for scanning at least a portion of one face of each envelope. Preferably, the line scan camera 42 scans the front face of each envelope to acquire image data corresponding to the front face.

The imaging camera 40 is a high resolution line scan camera suitable to achieve a 200×200 dpi image resolution. The acquisition rate of the camera is matched to the system transport speed so that a 200×200 dpi image resolution is achieved. The imaging camera 40 scans the envelopes and acquires data representing the light intensity at discrete points of each envelope. For each point, or pixel, the light intensity is represented by a gray scale number ranging from zero for black to 255 for white. The light intensity for each pixel is communicated to the computer as an eight bit representation corresponding to the gray scale number.

The image data is transferred to the computer, which analyzes the image data to determine the presence of particular characteristics. First, the computer utilizes a multiline optical character reader("MLOCR")in an attempt to identify the name and/or Post Office box number of the envelope recipient. In addition, the computer may analyze the image data to detect whether a mark was indicated in a response area on the envelope or the document within the envelope. For instance the computer may analyze the image data to determine whether the sender placed a check mark in a response box indicating that the sender's address changed.

In many instances, MLOCR will read approximately 90–95% of the envelopes processed. As is described further below, each envelope is processed at least two times, and typically three times. Accordingly, if the MLOCR positively identifies the envelope recipient, it may be desirable to print a readily identifiable marking indicative of the recipient. In this way, when the envelope is subsequently scanned, it is more likely that the envelope will be properly identified.

For instance, if an envelope recipient is identified based on the MLOCR of the scanned image, it may be desirable to print a bar code on the envelope because bar codes are much more likely to be properly read. For this purpose, a printer 45 may be provided for printing markings on identified envelopes. The printer may be a fluorescent ink-jet printer or a black ink-jet printer. The advantage of utilizing fluorescent ink is that other black printing on the envelope does not interfere with the scanning for a fluorescent bar code. However, if a fluorescent ink-jet printer is utilized, the apparatus must include a separate fluorescent reader 43. An added benefit of using a black ink-jet printer is that the printer can also be utilized to provide markings on the envelopes to assist in manual sorting at the work groups, as is discussed further below. If a black ink-jet printer is utilized, the computer may also analyze the image data for each envelope to detect an appropriate spot for printing the bar code that will not interfere with other printing on the envelope.

The envelopes are conveyed from the printer 45 to a cutter 60 that optionally opens at least one side of the envelopes that are qualified for opening. Envelopes that were electronically tagged and outsorted may or may not be opened, depending upon the preference of the user. For instance, it may be desirable to open all envelopes that are outsorted so that the contents can be readily examined to determine the reason for being outsorted. Preferably, the cutter is a shielded milling cutter that mills away one edge of the envelopes.

From the cutter, the envelopes are conveyed to a sorter 50. The sorter comprises a plurality of sort bins 52. The sorter directs each envelope to a particular bin in response to data about the envelope gathered during processing.

As shown in FIG. 1, the apparatus 10 includes a keyboard 22 that allows the operator to input information and select various operational parameters to control the operation of the apparatus. The apparatus also includes an output display in the form of a cathode ray tube 20.

Method of Operation

As described above, the apparatus 10 is operable to serially feed a batch of envelopes into the document path, scan the envelopes to determine the recipient of each envelope, and sort the envelopes into bins according to the recipient. In order to facilitate sorting a batch of mail into sequential order according to work group, the apparatus operates as follows.

Referring to FIG. 3, the method for sorting a batch of mail according to work group sequence is a multiple pass process utilizing a plurality of sort bins. The number of bins and number of passes are interrelated and both depend upon the number of accounts being processed by the wholesale lock-box processing center. For example if there are 1200 accounts, the mail can be placed into order in one pass using 1200 bins. Alternatively, using two passes, the mail can be placed into order using a number of bins equal to the square root of 1200. Similarly, the mail can be placed in order in three passes using a number of bins equal to the cube root of 1200. In other words, mail for X number of P.O. Boxes or accounts can be sorted into order in Y passes using a number of bins equal to the Y root of X. In the following example, exact sequence sorting is described in connection with mail for 1000 P.O. Boxes, numbered 000–999 (i.e. X=1000), using three passes (i.e. Y=3) and 10 bins (i.e. the cube root of 1000).

Referring to FIG. 3, a batch of mail is fed 100 into the apparatus. Each envelope is scanned 110 to obtain information indicative of the recipient. Specifically, the computer attempts to determine the recipient's name and/or Post Office box number utilizing multiline optical character recognition as discussed above. The apparatus then attempts to determine the recipient 120 of each envelope based upon the detected information. If the apparatus cannot determine the recipient of an envelope, the envelope is rejected 130 and handled separately as discussed further below. Preferably, each envelope is identified with a sort code that correlates with the recipient, as shown in FIG. 3 as step 140. However, a sort code need not be used in every application. In certain instances, the P.O. Box may be used for sorting. If desired, the envelopes are marked 150 with an identifier, such as a bar code. If the apparatus determines the recipient, the sorter sorts 160 the envelope according to the P.O. Box number. Specifically, the apparatus utilizes exact sequence sorting, in which the envelopes are sorted according to the least significant digit of the Post Office box number during the first pass. After the first pass is finished, the envelopes are swept from the bins 170 in sequential order. This means that the stack of envelopes in the first sort bin 52 is maintained in order and is placed in a tray in front of the stack of envelopes from the second sort bin, which in turn is placed in front of the third stack, and so on with the envelopes in the 10th bin being placed at the end of the stack.

The stack of envelopes is then processed through the apparatus for a second pass, during which the envelopes are sorted according to the second to least significant digit 175 of the Post Office box number. The envelopes are again swept from the bins in sequential order and fed into the apparatus for the third pass during which the envelopes are sorted according to the most significant digit of the Post Office box number. During the third pass, the envelopes are also opened 155. After the third pass is swept in sequential order, the envelopes are in sequential order according to Post Office box number.

For example, the following chart shows the results of exact sequence sorting for five envelopes having P.O. Box numbers 256, 689, 283, 801, and 067.

| | BIN NUMBER | | | | | | | | | |
|---|---|---|---|---|---|---|---|---|---|---|
| | 0 | 1 | 2 | 3 | 4 | 5 | 6 | 7 | 8 | 9 |
| 1st Pass | | 801 | | 283 | | | 256 | 067 | | 689 |
| 2nd Pass | 801 | | | | | 256 | 067 | | 283<br>689 | |
| 3rd Pass | 067 | | 256<br>283 | | | | 689 | | 801 | |

After the first pass, the envelopes were swept from the bins in order, so that the order of the envelopes as they are fed for the second pass is 801, 283, 256, 067, 689. Similarly, after the second pass the envelopes are swept from the bins in order so that the order of the envelopes as they are fed for the third pass is 801, 256, 067, 283, 689. After the third pass, when the envelopes are swept from the bins in order, the envelopes are in sequential order according to P.O. Box number.

Identifying Documents During Subsequent Passes

As discussed previously, the read rate of MLOCR is not as high as other optical scanning methods, such as bar code scanning. Since each envelope must be sorted three times, relying on MLOCR to identify the envelopes during all three passes can significantly decrease the overall read rate. For instance, if the apparatus is able to identify the recipient of 90 percent of the envelopes per pass using MLOCR, then the overall read rate for all three passes is reduced to approximately 73 percent (0.9*0.9*0.9*100). This is typically an unacceptable read rate. Accordingly, it is desirable to utilize a secondary identification mechanism for identifying the envelopes during passes after the first pass.

As noted above, one manner for improving recognition during subsequent passes is to mark each identified envelope with a barcode during the first pass. During subsequent passes, if the apparatus cannot identify the recipient of an envelope using MLOCR, the apparatus can read the barcode to determine the recipient. If the recipient is identified using either MLOCR or bar code scanning during subsequent passes the envelope need not be rejected. In fact, in light of the improved accuracy when a barcode is used, it may be desirable to use the barcode as the primary mechanism for identifying an envelope's recipients after the first pass.

Another secondary identification mechanism for identifying envelopes during subsequent passes relies upon monitoring the sequence of the envelopes during processing. As noted above, the apparatus tracks the identification, location and sequence of each envelope. If the exact order of the envelopes is maintained, the apparatus can identify an envelope based upon the sequential position of the envelope. By way of example, during the first pass, the 20th envelope fed through the system is identified by MLOCR as being directed to P.O. Box 100. The envelope is then sorted to the second sort bin, where it becomes the third envelope in the bin. After the first pass is completed, there are 75 envelopes in the first bin and the operator properly sweeps the bins in sequential order. During the second pass the apparatus cannot identify the 78th envelope using MLOCR. However, the data record for the 78th envelope indicates that it was the 20th envelope fed during the first pass, which was identified as P.O. Box 100. The apparatus can then sort the envelope accordingly. In fact, it may be desirable to use sequence based identification as the primary mechanism for identifying envelopes during subsequent passes. If the apparatus loses track of the sequence after a jam, an image of the envelope can be displayed to the operator for confirmation of the envelope's identity.

Another secondary identification mechanism operates similarly to the sequence tracking identified above. If the exact order of the envelopes is maintained as noted above, the apparatus can identify an envelope based upon the sequence and the identity of the preceding and succeeding envelopes. For instance, during a second pass, the apparatus scans the $18^{th}$ envelope and is unable to identify the P.O. Box number using MLOCR. From the results of the first pass, the apparatus expects the $17^{th}$ envelope to be a particular P.O. Box, which was identified during the first pass. If the scanned results for the $17^{th}$ envelope matches the expected results, then it is likely that the exact sequence has been maintained, so that the apparatus can determine the identity of the $18^{th}$ envelope by assuming it is the expected identity based upon the results from the first pass.

The reliability of this method can be further increased by checking the preceding and succeeding envelopes. In other words, if the identity of the $18^{th}$ envelope cannot be determined by MLOCR, the $17^{th}$ envelope and the $19^{th}$ envelopes are evaluated. If the scanned results of the $17^{th}$ and $19^{th}$ envelopes match the expected results then it can be assumed that the sequence of the envelopes has been properly maintained during the current pass. Therefore, the P.O. Box of the $18^{th}$ envelope is assumed to be the expected P.O. Box, which was identified in a previous pass.

Yet another secondary identification mechanism for identifying envelopes during subsequent passes utilizes the U.S.P.S. fluorescent I.D. tag barcode that is marked on a significant percentage of mail. In particular, the majority of incoming mail for a wholesale lockbox processing center company has already been coded by the U.S.P.S. or a pre-sort bureau with a unique fluorescent code. When an envelope is scanned during the first pass for MLOCR, the apparatus can also scan the envelope to locate and identify the U.S.P.S. fluorescent code. The U.S.P.S. code can then be correlated with the recipient of the envelope, so on subsequent passes, an envelope can be identified by either MLOCR or the U.S.P.S. fluorescent barcode.

Another secondary identification mechanism for identifying envelopes during subsequent passes utilizes other data acquired during the first pass. For instance the height, length and thickness of each envelope may be obtained during the first pass. In addition, optical image data such as optical pattern data and MLOCR results are obtained during the first pass. Accordingly, this information, referred to as the envelope fingerprint, can be used to create a substantially unique identification of each envelope. During subsequent passes, this information can be utilized to identify an envelope if MLOCR cannot.

Further still, the above secondary identification mechanisms can be combined to increase the recognition rate of envelopes during subsequent passes. For instance, scanning for the U.S.P.S. fluorescent code may provide a good identification mechanism by itself. However, not every envelope has a U.S.P.S. fluorescent code. Therefore, the U.S.P.S. fluorescent code identification mechanism can be combined with sequence based identification to create a secondary identification mechanism that is applicable to all of the envelopes and is highly reliable. Similarly, the envelope fingerprint identification mechanism can be combined with the U.S.P.S. fluorescent code identification or sequence based identification to improve reliability during subsequent passes.

Sorting According to Work Group Sequence

As detailed above, the output from exact sequence sorting is in numerical order according to P.O. Box number. However, as previously discussed, typically the P.O. Box numbers assigned to work groups are not arranged according to strict sequential numerical order. Accordingly, it is desirable to provide a method for sorting that permits sorting the envelopes into any order.

To facilitate such sorting, a sort code or logical sequence number is assigned to each account (i.e. each P.O. Box number). The sort numbers are assigned to correspond to the desired arrangement of the accounts within the work groups. For instance, sort number 000 may be assigned to the first account in the first work group, and logical sequence number 001 may be assigned to the second account in the first work group.

During processing, the apparatus identifies the recipient of an envelope as described above. The apparatus then correlates the recipient with the sort number assigned to the recipient. The envelope is then sorted according to exact sequence sorting based upon the sort number rather than the P.O. Box number. The output of such sorting is a stack of mail in the desired sequence order for each work group. The mail can then be readily distributed to the work groups without further sorting.

Optimizing the Number of Bins and Passes

As set forth above, the exact sequence sorting procedure was described in connection with a hypothetical situation having 1000 accounts, 10 bins and using three passes. Exact sequence sorting is optimized for such a situation. However, difficulties arise if the number of accounts increases. For instance, if there are 1400 accounts, more passes must be used. Specifically, the process must include four passes. However, a four pass system can accommodate up to 10,000 accounts. Therefore, such a process is clearly not optimized for processing 1400 accounts.

One manner of optimizing the number of bins and passes utilizes sort numbers having a radix or base that corresponds to the number of bins. If 10 bins are used, the sort numbers will have a radix of 10 and as in the example described above the system will accommodate a three pass system for 1000 accounts. However, in many situations, the radix of the sort numbers will not be 10. For instance, processing 1400 accounts in three passes requires a number of bins equal to the cube root of 1400, which is 11.19. This number must be rounded up to the next full number or integer to determine the minimum number of bins required. Accordingly, 12 bins are required. To sort the envelopes into 12 bins, each account is assigned a base 12 sort number. The envelopes are then sorted according to the base 12 sort number.

This optimized sorting can be readily combined with the method for sorting the envelopes into work group sequence. For such a process, the sort numbers assigned to each account have the appropriate radix and are assigned according to the desired arrangement of the accounts within the work groups. To illustrate such a system, the following table presents a simplified hypothetical situation in which there are 27 accounts. Twenty-seven accounts can be efficiently sorted into three bins in three passes. Since there are three bins, the radix of the sort numbers is three.

| Customer Name | Lockbox Number | Work Group | Cubby No. | Base 3 Sequence No. |
|---|---|---|---|---|
| Nadine's Art | 4544 | 1 | 1 | 000 |
| George's Potatoes | 5677 | 1 | 32 | 001 |
| Ingred's Ice Cream | 4674 | 1 | 44 | 002 |
| Dave's Diapers | 7657 | 1 | 45 | 010 |
| Bob's Golf | 3433 | 1 | 76 | 011 |
| Danielle's Dogs | 4555 | 2 | 23 | 012 |
| Laura's Cats | 3467 | 2 | 67 | 020 |
| Jessica's Nails | 3218 | 2 | 87 | 021 |
| Greg's Goats | 3748 | 2 | 98 | 022 |
| Al's Apples | 2453 | 2 | 145 | 100 |
| Justin's Music | 4493 | 3 | 12 | 101 |
| Vanilla's Fish | 1234 | 3 | 12 | 102 |
| Maddy's Coats | 3455 | 3 | 44 | 110 |
| Harry's Hats | 2222 | 3 | 78 | 111 |
| Bill's Balloons | 134 | 4 | 23 | 112 |
| Marie's Mittens | 9586 | 4 | 45 | 120 |
| Zeke's Collars | 3455 | 4 | 76 | 121 |
| Emma's Furniture | 4378 | 4 | 87 | 122 |
| Ed's Erasers | 9836 | 4 | 112 | 200 |
| Leon's Lollipops | 8766 | 5 | 1 | 201 |
| Nina's Nickels | 45 | 5 | 12 | 202 |
| Charlie's Cats | 2398 | 5 | 76 | 210 |
| Judie's Jam | 1032 | 5 | 176 | 211 |
| Fred's Flowers | 49 | 6 | 3 | 212 |
| Len's Books | 4454 | 6 | 34 | 220 |
| Don's Stocks | 5678 | 6 | 89 | 221 |
| New Customer | | | | 222 |

As can be seen from this chart, the sequence numbers can be assigned to the lockbox number in any order desired by the end user. For instance, rather than having the first number be the first lockbox number of the first group, the numbers can be arranged according to priority, so that the first sequence number corresponds to the highest priority for the first work group.

Separation Techniques

As noted previously, each work group typically has a sort rack for receiving the mail assigned to it. Accordingly, although the process described above sorts the mail into work group order, separating the mail by work group still requires flipping through the mail and looking at the P.O. Box numbers. Furthermore, once the work arrives at the work group area, it is desirable to provide easy separations to improve manual sorting into the bins of each work group sort rack.

One method for separating the accounts is to assign each group to a particular bin. For instance, if there are 10 bins and 10 groups each bin is assigned for the documents for one of the groups. In this way, after the last pass, all of the documents for a particular group are in a separate bin. When the bins are swept after the third pass, the envelopes for a group can be separated from the remaining envelopes in one of several ways. A rubber band can be placed around the envelopes in a bin before the envelopes are placed in a mail tray with the rest of the processed mail. Alternatively, the operator can place a separator card between successive mail groups as the bins are swept. Alternatively, the groups can be offset as they are placed into the mail trays.

In the above example, there were 10 bins and 10 groups. However, often the number of bins will not match the number of groups. If the number of bins is greater than the number of groups, one or more bins can be assigned to more than one group. If the number of bins is less than the number of groups, more than one group is assigned to one or more bins.

The bins can be assigned to the groups by the manner in which the sort numbers are assigned to the lock boxes in a group. In the example with 10 groups and 10 bins for a three-pass system, the sort numbers are assigned so that the sort numbers assigned to groups 1 are from 0 to 99; the sort numbers assigned to group 2 are from 100 to 199, and so on. In this way, when the envelopes are sorted sequentially according to sort number, all of the envelopes for group 1 will be in order in bin 1, all of the envelopes for group 2 will be in bin 2, and so on.

Another method of separating the accounts is to use separator cards that are marked with the corresponding account numbers. The separator cards are inserted at the front end of the batch of mail and processed as if they are envelopes. Since the separator cards are first and have the first account number or sequence number of each work group, the separator cards provide an effective separation between the work groups. Similarly a separator card can be provided for each account, thereby separating the accounts from one another.

In some instances it may be desirable to mark the separator cards with a unique identifier so that the controller can identify the card as a separator card as opposed to an envelope. One manner for doing so is to assign certain sort numbers to the separator cards that are not assigned to lock boxes. Each separator card is marked with one of these sort numbers. In this way, when a document is scanned and the apparatus determines the sort number, the apparatus can determine whether the document is an envelope or a separator card based on the scanned sort number.

Another method of identifying separations between accounts is to mark the edges of the envelopes. The printer 45 can print a black mark on the edge of each envelope such that the position of the mark shifts when a separation is desired. The edge markings can be used to facilitate manually separating the envelopes after they are sorted. Furthermore, a sort code can be printed on each envelope that identifies the row and column into which the envelope is to be sorted at the work group sort racks. Preferably, the printer mark would be on the leading or bottom edge of the envelopes since these edges are typically aligned for all of the envelopes in a batch.

In addition, a combination of separator cards and envelope printing may also be utilized. The separator cards can be utilized to separate the stack of mail into handful-sized stacks. Once the envelopes are in hand, the edge markings are visible for separating envelopes with the same P.O. Box number and the two digit bin matrix code for the work group sort rack printed on the front can be viewed to target the proper bin.

Reject Processing

As discussed previously, if the apparatus cannot identify the recipient of an envelope, the envelope is rejected. These envelopes need to be processed. One manner is to manually sort the rejects according to the traditional manual method described previously. This may be acceptable if the amount of rejects is limited. However, there may be enough rejects that such manual sorting is cumbersome.

Accordingly, it may be desirable to utilize local video encoding to process rejects. Such a process utilizes the scanned images used for MLOCR. If an envelope is rejected, the envelope image is saved to a network drive or to the system hard drive. To process the rejects, the image of each rejected envelope is presented to a keying operator. The operator keys in the P.O. Box number and the envelope is "ID tagged" so that on subsequent passes the envelope can be recognized and sorted according to the keyed data. The rejected envelopes can be ID tagged according to one of a number of methods. For instance, the envelopes can be marked with a fluorescent ink or black ink bar code, or the U.S.P.S. fluorescent code on the envelope can be used to identify the envelope, as well as envelope fingerprinting. Further, sequence-based identification can also be used. If the exact sequence of the rejects is maintained and the keyed data is assembled in the exact order that it was acquired, it is possible to sort the envelopes with this basis alone on subsequent passes. If the system loses track after a jam, an image of the next envelope can be displayed for confirmation.

Quick-Kills

Frequently, it may be desirable to provide additional sort bins to allow the largest accounts to be finalized in the first pass, while still grouping the rest of the mail for subsequent passes. These are referred to as quick kills. For example, a wholesale lockbox processing center company may have two accounts that are quite large. The company may want to separate mail for these clients on the first pass. A simplistic approach to this would be to add enough bins to provide for the two quick-kill accounts. For instance, if processing the mail would ordinarily require 10 bins, two more bins can be provided to accommodate the quick-kills. However, this results in two unused bins in subsequent passes. Accordingly, a more efficient process would utilize the quick kill bins in subsequent passes.

One such method utilizes sort numbers assigned to the accounts as described above. However, the number of available sort numbers for a given number of bins is reduced by the number of quick kill bins. For instance, returning again to the sample of 10 bins and three passes, if it is desired to have five quick kill bins it is no longer possible to process 1000 accounts in three passes. Instead, the maximum number of accounts for three passes would be 505. This number is derived as follows: (number of bins-number of quick-kill bins)*(number of bins available on second pass)*(number of bins available on the third pass)+number of quick-kill bins.

To facilitate processing, the sort numbers are assigned as follows. The number of either the most significant or the least significant digits available is equal to number of bins minus the number of quick-kill bins. For example, if there are 10 bins and five quick kill bins, and the first pass is sorted according to the least significant digit of the sort numbers, then the sort numbers are assigned so that the least significant digit only uses five of the 10 available digits. For instance, one solution is to not assign any even numbers. In this way, during the first pass the first five bins will receive quick-kills. Bin 6 will receive all envelopes having a sort number ending in one, bins seven would receive all envelopes having a sort number ending in three, bins eight will receive all envelopes having a sort number ending in five, bin nine will receive all envelopes having a sort number ending in seven and bin 10 will receive all envelopes having a sort number ending in nine. On the second and third passes all 10 bins will be available. In this way, the number of bins is optimized, as well as the number of passes.

It will be recognized by those skilled in the art that changes or modifications may be made to the above-described embodiments without departing from the broad inventive concept of the invention. It should therefore be understood that this invention is not limited to the particular embodiments described herein but is intended to include all changes and modifications that are within the scope and spirit of the invention as set forth in the claims.

What is claimed is:

1. A method for processing documents for a plurality of recipients, comprising the steps of:

conveying documents along a document path;

scanning the documents as the documents are conveyed along the document path to determine a characteristic indicative of the recipient of each document;

providing a plurality of bins for receiving the documents, wherein the number of bins is less than the number of recipients;

selecting a radix for logical sequence numbers for the documents, such that the radix corresponds to the number of bins;

assigning logical sequence numbers to the documents, wherein the logical sequence number for each document corresponds to the recipient of the document; and sorting the documents into the bins according to the logical sequence numbers.

2. The method of claim 1 comprising the step of sorting the documents into sequential order according to the logical sequence numbers.

3. The method of claim 1 wherein the step of sorting comprises the step of a first sorting pass of sorting the documents into the bins according to one of either the least significant digit of the logical sequence numbers or the most significant digit of the logical sequence numbers.

4. The method of claim 3 comprising a second sorting pass of sorting the documents into the bins according to one of either the second least significant digit of the logical sequence numbers or the second most significant digit of the logical sequence numbers.

5. The method according to claim 3 comprising the step of sorting documents having a particular logical sequence number to a bin during the first pass.

6. The method according to claim 1 comprising the step of marking the documents with a mark after scanning the documents, wherein the mark applied to a particular document corresponds to the recipient of the particular document.

7. The method according to claim 1 comprising the step of marking the documents with a mark along one of the edges of the documents.

8. The method according to claim 7 wherein the location of the edge-marking is variable and the method includes the step of determining the location of the edge-marking for each document in response to the recipient of each document.

9. The method according to claim 8 wherein the step of sorting comprises first and second sorting passes of sorting the documents into the bins, and the method comprises the step of scanning the marks on the documents during the second pass.

10. A method for processing documents for a plurality of recipients, comprising the steps of:

providing a batch of documents;

conveying the documents along a document path;

scanning each of the documents in the batch to determine a characteristic indicative of the recipient of each document;

providing a sorting apparatus for sorting the documents according to the determined characteristic, wherein the sorting apparatus has a number of bins for receiving the documents and the number of bins is less than the number of recipients; and optimizing the number of times for feeding the documents into the sorting apparatus to sort the documents into an ordered series.

11. A method for processing documents for a plurality of recipients utilizing a sorting apparatus having a number of bins, comprising the steps of:

providing a batch of documents;

conveying the documents along a document path;

scanning each of the documents in the batch to determine a characteristic indicative of the recipient of each document;

selecting the number of times for feeding the documents into the sorting apparatus to sort the documents into an ordered series; and optimizing the number of bins in the sorting apparatus for the number of times the documents are fed into the sorting apparatus and the number of recipients.

12. A method for processing documents for a plurality of recipients utilizing a sorting apparatus having a number of bins, comprising the steps of:

conveying documents along a document path;

scanning the documents as the documents are conveyed along the documents path to determine a characteristic indicative of the recipient of each document;

assigning logical sequence numbers to the documents, wherein the logical sequence number for each document corresponds to the recipient of the document;

sorting the documents into a plurality of bins according to the logical sequence numbers; and selecting the radix of the logical sequence numbers, wherein the radix corresponds to the number of bins.

13. The method of claim 12 wherein the number of recipients is greater than the number of bins.

14. The method of claim 12 comprising the step of sorting the documents into sequential order according to the logical sequence numbers.

15. The method of claim 12 wherein the step of sorting comprises the step of a first sorting pass of sorting the documents into the bins according to one of either the least significant digit of the logical sequence numbers or the most significant digit of the logical sequence numbers.

16. The method of claim 15 comprising a second sorting pass of sorting the documents into the bins according to one of either the second least significant digit of the logical sequence numbers or the second most significant digit of the logical sequence numbers.

17. The method according to claim 15 comprising the step of sorting documents having a particular logical sequence number to a bin during the first pass.

18. The method according to claim 12 comprising the step of marking the documents with a mark after scanning the documents, wherein the mark applied to a particular document corresponds to the recipient of the particular document.

19. The method according to claim 18 wherein the step of sorting comprises first and second sorting passes of sorting the documents into the bins, and the method comprises the step of scanning the marks on the documents during the second pass.

20. The method according to claim 18 comprising the step of providing a plurality of separation cards having markings, scanning the cards to identify the marking on each card and sorting the cards into the bins according to the markings so that the cards separate documents for each group of recipients.

21. The method according to claim 12 comprising the step of marking the documents with a mark after scanning the documents, wherein the mark applied to a particular document corresponds to the recipient of the particular document.

22. The method according to claim 12 comprising the step of marking the documents with a mark along one of the edges of the documents.

23. a method for processing documents for a plurality of recipients, comprising the steps of:

performing a first pass sort comprising the steps of:

conveying a document along a document path;

scanning the document as the document is conveyed along the document path to determine a first characteristic indicative of the recipient of the document;

scanning the document as the document is conveyed along the document path to determine a second characteristic of the document;

determining the recipient of the document in response to the scanned first characteristic;

performing a second pass sort comprising the steps of:

conveying the document along the document path;

scanning the document as the document is conveyed along the document path to determine the second characteristic of the document; and determining the recipient of the document based on the scanned second characteristic.

24. The method of claim 23 wherein during the first pass, the second characteristic is non-indicative of the recipient.

25. The method according to claim 23 comprising the step of sorting the document in response to the identification of the recipient determined during the first pass.

26. The method according to claim 25 comprising the step of sorting the document in response to the identification of the recipient determined during the second pass.

27. The method according to claim 23 comprising the step scanning the document during the first and second passes to determine a third characteristic of the document and determining the recipient of the document based on the scanned second and third characteristics during the second pass.

28. A method for processing documents, comprising the steps of:

performing a first pass comprising the steps of:

serially conveying a first document and a second document along a document path;

scanning the first and second documents as the documents are conveyed along the document path to determine a first characteristic of the documents;

sorting the documents;

performing a second pass comprising the steps of:

serially conveying the documents along the document path;

scanning the first document as the first document is conveyed along the document path to determine the first characteristic of the first document;

comparing the first characteristic for the first document scanned during the second pass with the first characteristic for the first document scanned during the first pass to determine a characteristic of the second document during the second pass.

29. The method of claim 28 wherein the first and second documents are immediately adjacent each other as the documents are conveyed during the second pass.

30. A method for processing documents for a plurality of recipients, comprising the steps of:

performing a first pass, comprising the step of:

serially conveying a first document and a second document along a document path;

determining the recipient of the documents;

performing a second pass, comprising the steps of:

serially conveying the first and second documents so that the first document precedes the second document along the document path;

scanning the first document to determine a characteristic of the first document;

determining the recipient of the first document in response to the determined characteristic; and determining the recipient of the second document in response to the determined recipient for the first document.

31. The method of claim 30 wherein the first document immediately precedes the second document as the documents are conveyed along the document path during the second pass.

32. The method of claim 30 comprising the step of scanning the documents during the first pass to determine a characteristic of the documents.

33. The method of claim 32, comprising the step determining the recipients of the documents during the first pass in response to the determined characteristic.

34. The method of claim 33 comprising the step of sorting the documents during the first pass in response to the determined recipient for each document.

35. The method of claim 30 comprising the step of sorting the documents during the second pass in response to the determined recipient for each document.

36. The method of claim 30, wherein:

the first pass comprises the steps of:

conveying a third document along the document path;

scanning the third document to determine a characteristic of the third document;

determining the recipient of the third document in response to the determined characteristic of the third document;

sorting the third document in response to the determined recipient for the third document; and the second pass comprises the steps of:

serially conveying the third document so that the third document immediately succeeds the second document along the document path;

scanning the third document to determine the characteristic of the third document;

determining the recipient of the third document in response to the determined characteristic of the third document; and determining the recipient of the second document in response to the determined recipients for the first and third documents.

37. A method for processing documents, comprising the steps of:

performing a first pass, comprising the steps of:

scanning a document to obtain data regarding a first characteristic of the document;

determining the recipient of the document;

sorting the document in response to the determined recipient;

performing a second pass, comprising the steps of:

scanning the document to obtain data regarding the first characteristic of the document;

comparing the scanned data obtained during the second pass with the scanned data obtained during the first pass;

determining the recipient of the document in response to the comparison.

38. The method of claim 37 wherein the first characteristic is the height, width or thickness of the envelope.

39. The method of claim 37 wherein the first characteristic is the image of at least a portion of the document.

40. The method of claim 37 comprising the steps of:

scanning the document to obtain data regarding a second characteristic of the document during the first pass;

scanning the document to obtain data regarding the second characteristic of the document during the second pass;

comparing the scanned data obtained during the second pass regarding the second characteristic with the scanned data obtained during the first pass regarding the second characteristic; and determining the recipient of the document in response to the comparison of the data regarding the first and second characteristics.

41. The method of claim 40 wherein the second characteristic is the height, width or thickness of the document.

42. The method of claim 40 wherein the second characteristic is the image of at least a portion of the document.

43. A method for processing documents, comprising the steps:

conveying documents along a document path;

scanning the documents to determine a characteristic of each document;

determining a print location on each document in response to the scanned characteristic for each document;

printing a mark in the determined print location for each document; and sorting the documents into groups wherein documents in the same group have the same print location.

44. The method of claim 43 wherein documents having the same scanned characteristic have the same print location.

45. The method of claim 43 wherein documents having different scanned characteristic have different print locations.

* * * * *